US007584553B1

(12) United States Patent
Medley

(10) Patent No.: US 7,584,553 B1
(45) Date of Patent: Sep. 8, 2009

(54) FLIP FLOP GOLF SANDAL

(76) Inventor: Mark M. Medley, 834 Perrine Rd., Farmington, MO (US) 63640

( * ) Notice: Subject to any disclaimer, the term of this patent is extended or adjusted under 35 U.S.C. 154(b) by 699 days.

(21) Appl. No.: 11/400,086

(22) Filed: Apr. 7, 2006

(51) Int. Cl.
*A43B 3/12* (2006.01)

(52) U.S. Cl. ..... 36/11.5; 36/127

(58) Field of Classification Search ..... 36/7.5, 36/11.5, 127, 14; 12/142 S
See application file for complete search history.

(56) References Cited

U.S. PATENT DOCUMENTS

| | | | | | |
|---|---|---|---|---|---|
| 1,497,852 | A | * | 6/1924 | Hooper | 36/15 |
| 3,019,533 | A | | 2/1962 | Smith | |
| 3,336,683 | A | * | 8/1967 | Schellkopf | 36/11.5 |
| 3,597,863 | A | * | 8/1971 | Austin et al. | 36/59 R |
| 3,738,026 | A | * | 6/1973 | Granger | 36/59 R |
| RE29,041 | E | * | 11/1976 | Fukuoka | 36/11.5 |
| 4,020,569 | A | * | 5/1977 | Fukuoka | 36/29 |
| 4,051,610 | A | * | 10/1977 | Shigeji | 36/11.5 |
| 4,525,939 | A | | 7/1985 | McNeil | |
| 5,687,492 | A | | 11/1997 | Muraoka | |
| 5,689,901 | A | * | 11/1997 | Bell et al. | 36/7.6 |
| 5,802,738 | A | * | 9/1998 | Ferniani | 36/11.5 |
| 5,992,053 | A | | 11/1999 | Hansen | |
| 6,154,982 | A | * | 12/2000 | Bell et al. | 36/7.6 |
| D477,129 | S | | 7/2003 | Ramer | |
| D496,523 | S | | 9/2004 | Fuerst | |

OTHER PUBLICATIONS

Golfshoesplus.com, Nov. 14, 2005, 3 pages.

* cited by examiner

*Primary Examiner*—Marie Patterson
(74) *Attorney, Agent, or Firm*—Polster, Lieder, Woodruff & Lucchesi, L.C.

(57) ABSTRACT

A flip flop sandal comprising a sole portion made from a flexible, resilient and moldable material. The sole has an upper surface and a lower surface. Molded within the upper surface is a foot attachment strap having an enlarged end captured within the sole portion. The largest dimension of the enlarged end portion is about 8 to 16 times larger at its largest dimension than the thickness of the foot strap where it meets the upper surface of the sole portion. Also molded within the sole portion are a plurality of spikes. The spikes comprise a lower exposed portion for gripping the surface upon which the wearer walks and a upper bud portion that extends away from the lower portion at a first diameter and expands to a larger diameter farther from the lower portion. The larger diameter is molded within the sole portion. It is important to note that the floor, which is depressed from the raised portions, follows the outline of the wearer's foot to maintain the foot within the flip flop sandal, particularly when the wearer is swinging a golf club.

16 Claims, 1 Drawing Sheet

FLIP FLOP GOLF SANDAL

FIELD OF THE INVENTION

The invention relates to footwear. More specifically, the invention relates to a flip flop golf sandal specifically adapted for playing golf.

BACKGROUND OF THE INVENTION

Golfers typically wear shoes on the golf course that resemble a common shoe and incorporate spikes for greater traction when swinging a golf club. While golf is also played for competition, the majority of golfers play for exercise, relaxation and socialization. Therefore, many golfers are interested in looking stylish and wearing clothing and shoes that provide maximum comfort.

Additionally, many people prefer to wear sandals or are just looking for something different to wear while golfing. As a result, there is a need in the art for a flip flop sandal specifically adapted for the game of golf.

SUMMARY OF THE INVENTION

The present invention provides a flip flop sandal comprising a sole portion made from a flexible, resilient and moldable material. The sole has an upper surface and a lower surface. Molded within the upper surface is a foot attachment strap having an enlarged end captured within the sole portion. The largest dimension of the enlarged end portion is about 8 to 16 times larger at its largest dimension than the thickness of the foot strap where it meets the upper surface of the sole portion. Also molded within the sole portion are a plurality of spikes. The spikes comprise a lower exposed portion for gripping the surface upon which the wearer walks and a upper bud portion that extends away from the lower portion at a first diameter and expands to a larger diameter farther from the lower portion. The larger diameter is molded within the sole portion.

DESCRIPTION OF THE PREFERRED EMBODIMENT

Figure 1:
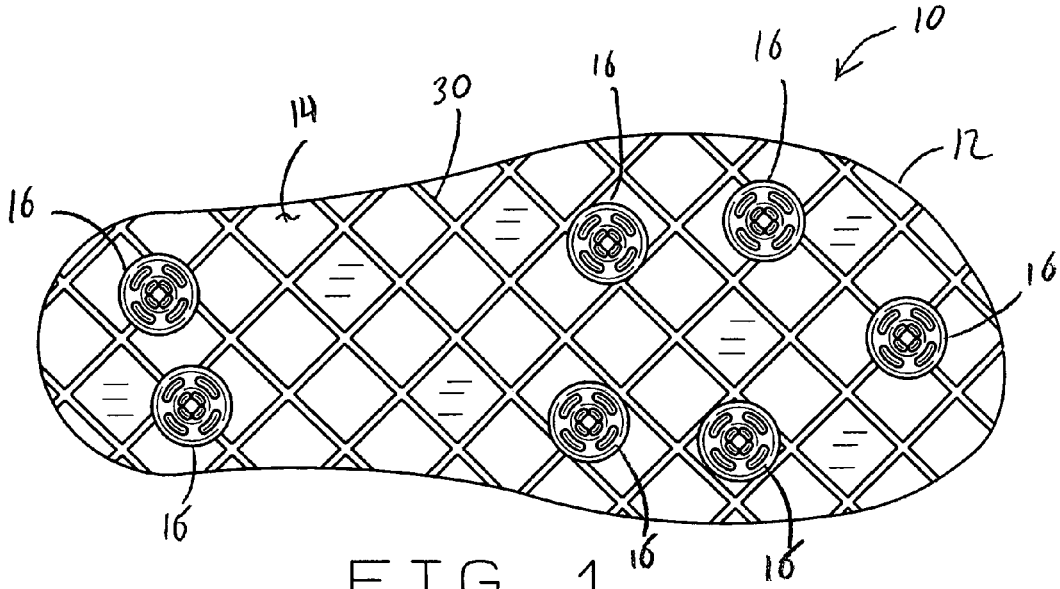
FIG. 1 is a bottom view of a flip flop golf sandal according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
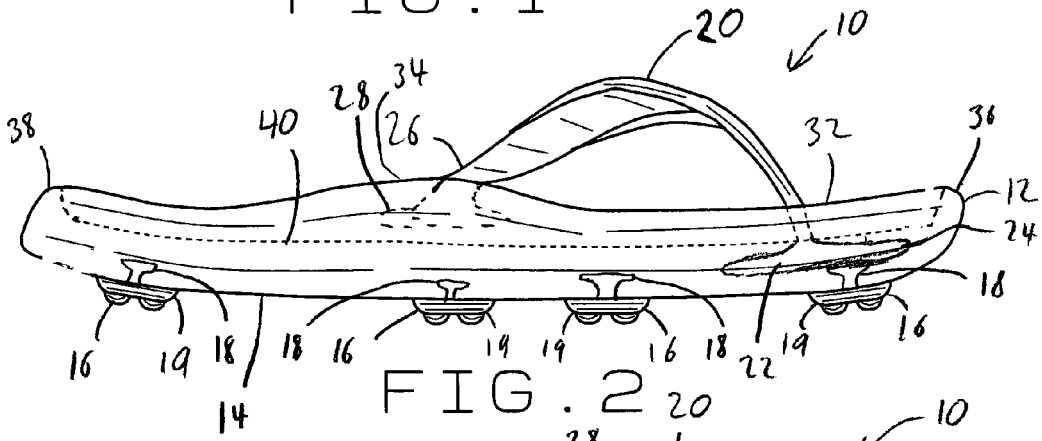
FIG. 2 is a side view of a flip flop golf sandal according to an embodiment of the present invention.

The preferred embodiment of the present invention comprises a flip flop sandal specifically adapted for playing golf. Referring to FIGS. 1 and 2, a flip flop sandal 10 comprises a molded sole portion 12 and a foot strap 20.

The sole portion 12 is preferably molded from a resilient and flexible thermoset polymer. Molded within the polymer and on the bottom surface 14 of the sole portion 12 are a plurality of spikes 16. The spikes 16 are placed about the bottom surface 14 of the sole portion 12 as shown in FIG. 1 and provide additional traction for the flip flop sandal wearer, particularly when swinging a golf club.

The spikes 16 comprise a bud 18 which extends upwardly form the top of the spike 16 and is molded within the sole portion 12. In this manner, the spikes 16 are securely and removably affixed to the sole portion 12. The bottom portion 19 of the spike 16 is in the form of a conventional "soft spike" which is commonly used on golf courses today to preserve the golf course playing surface. However, it would be within the scope of the present invention to provide "hard" or metal spikes in conjunction with the sole portion 12 in the same manner as the soft spikes shown. The bottom portion 19 of the spike 16 is preferably removable from the bud 18, such that the bottom portion 19 may be replaced when worn or that the wearer can even wear the flip flop sandal without spikes no longer playing golf. The bottom portion 19 may be threaded into the bud 18 or may be inserted within the bud 18 with an interference fit. However, it is within the scope of the present invention to have a non-removable spike as well.

Figure 3:
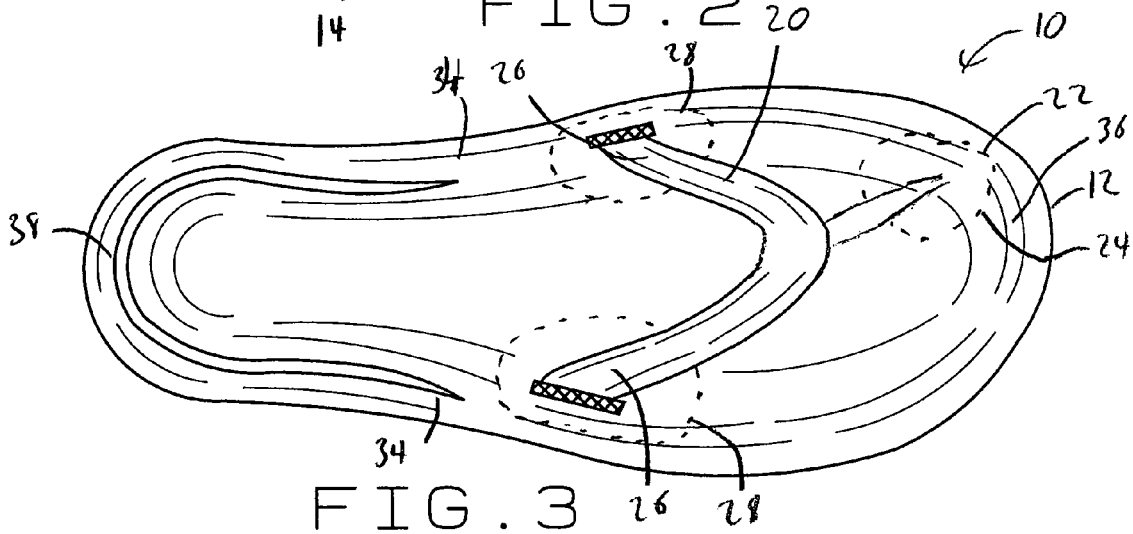
FIG. 3 is a top of a flip flop golf sandal according to an embodiment of the present invention.

Also molded within the sole portion 12 is a foot strap 20 for holding the flip flop sandal 10 to the wearer's foot. The exposed portion of the foot strap 20 is preferably in the form of common foot straps, such as foot straps that incorporate hook and loop material (sold under the trademark VELCRO) for adjustability or foot straps that go between wearer's toes, as shown, or foot straps that do not go between a wearer's toes but rather loop over the wearer's entire foot, as are all commonly known. However, the foot strap 20 differs from the prior art in that the portion 22 that is molded into the sole portion 12 is enlarged and embedded within the sole portion 12. The enlarged end portion 22 is preferably a flangelike enlargement molded integrally with the foot strap 20 for strength and of a diameter, most preferably, of about 2 inches at the toe end 24 of the foot strap 20, with the foot strap 20 itself being in the range of about ⅛ of an inch to ¼ of an inch in diameter where it meets the top portion 32 of the sole portion 12. Therefore, the enlarged end portion 22 is preferably about eight to sixteen times larger at its largest dimension than the thickness of the foot strap 20 where it meets the top portion 32 of the sole portion 12. The rear ends 26 of the foot strap 20 also comprise a flangelike enlarged end portion 28 that is molded within the sidewall of the flip flop sandal 10, as described below. The rear end portions 28 are appropriately sized and may be offset with respect to the center of the enlarged end portions 28 to accommodate their placement near the edge of the flip flop sandal 10, as shown in FIG. 3.

Furthermore, the bottom of the flip flop sandal 10 may include a pattern 30 for additional traction.

The top portion 32 of the flip flop sandal 10 is also formed to provide additional footing for the flip flop sandal wearer to prevent the wearer's foot from sliding off of the flip flop sandal when swinging a golf club. Preferably, the top portion 32 is formed with two raised sides 34, a raised front 36 and raised rear 38. The raised portions 34-38 form a floor 40 on which the wearer's foot rests and is captured. It is important to note that the floor 40, which is depressed from the raised portions 34-38, follows the outline of the wearer's foot to maintain the foot within the flip flop sandal 10, particularly when the wearer is swinging a golf club.

The present improved flip flop sandal lends itself perfectly for golf in that the enlarged end portions are more rigidly attached to the flip flop sandal sole portion for strength and will not pull loose from the sole when even when the user is applying a large pulling force, such as when swinging a golf club. Moreover the spikes are similarly maintained within the sole portion by the upwardly extending buds. Finally, the depressed floor of the flip flop sandal and raised sidewalls prevent slippage of the wearer's foot within the flip flop sandal.

While the specific embodiments have been illustrated and described, numerous modifications come to mind without significantly departing from the spirit of the invention, and the scope of protection is only limited by the scope of the accompanying claims.

I claim:

1. A flip flop sandal comprising:

a sole portion comprising a flexible, resilient and moldable material having an upper surface and a lower surface; molded within the upper surface is a foot attachment strap having an enlarged end that is molded within the sole portion, the largest dimension of the enlarged end portions being about 8 to 16 times larger at its largest dimension than the thickness of the foot strap where it meets the top portion of the sole portion; also molded within the sole portion are a plurality of spikes, the spikes comprising a lower exposed portion for gripping the surface upon which the wearer walks and a upper bud portion that extends away from the lower portion at a first diameter and expands to a larger diameter farther from the lower portion, the larger diameter being molded within the sole portion.

2. The flip flop sandal of claim 1 wherein the top portion of the sole portion comprises raised sides and a depressed floor portion for supporting a foot of a wearer.

3. The flip flop sandal of claim 1 wherein the largest dimension of the enlarged end portions being about 10 to 16 times larger at its largest dimension than the thickness of the foot strap where it meets the top portion of the sole portion.

4. The flip flop sandal of claim 1 wherein the largest dimension of the enlarged end portions being about 12 to 16 times larger at its largest dimension than the thickness of the foot strap where it meets the top portion of the sole portion.

5. The flip flop sandal of claim 1 wherein the largest dimension of the enlarged end portions being about 14 to 16 times larger at its largest dimension than the thickness of the foot strap where it meets the top portion of the sole portion.

6. The flip flop sandal of claim 1 wherein the largest dimension of the enlarged end portions being about 16 times larger at its largest dimension than the thickness of the foot strap where it meets the top portion of the sole portion.

7. A flip flop sandal comprising:

a sole portion comprising a flexible, resilient and moldable material having an upper surface and a lower surface, molded within the upper surface is a foot attachment strap having a plurality of enlarged ends that are molded within the sole portion, the largest dimension of the enlarged end portions being about 8 to 16 times larger at their largest dimensions than the thickness of the foot strap where it meets the top portion of the sole portion adjacent the enlarged end and also molded within the sole portion are a plurality of spikes, the spikes comprising a lower exposed portion for gripping the surface upon which the wearer walks and a upper bud portion that extends away from the lower portion at a first diameter and expands to a larger diameter farther from the lower portion, the larger diameter being molded within the sole portion.

8. The flip flop sandal of claim 7 wherein the top portion of the sole portion comprises raised sides and a depressed floor portion for supporting a foot of a wearer.

9. The flip flop sandal of claim 7 wherein the largest dimension of the enlarged end portions being about 10 to 16 times larger at its largest dimension than the thickness of the foot strap where it meets the top portion of the sole portion.

10. The flip flop sandal of claim 7 wherein the largest dimension of the enlarged end portions being about 12 to 16 times larger at its largest dimension than the thickness of the foot strap where it meets the top portion of the sole portion.

11. The flip flop sandal of claim 7 wherein the largest dimension of the enlarged end portions being about 14 to 16 times larger at its largest dimension than the thickness of the foot strap where it meets the top portion of the sole portion.

12. The flip flop sandal of claim 7 wherein the largest dimension of the enlarged end portions being about 16 times larger at its largest dimension than the thickness of the foot strap where it meets the top portion of the sole portion.

13. A flip flop sandal comprising:

a sole portion comprising a flexible, resilient and moldable material having an upper surface and a lower surface, molded within the upper surface is a foot attachment strap having a plurality of enlarged ends that are molded within the sole portion, the largest dimension of each enlarged end portion being about 10 to 16 times larger at its largest dimension than the thickness of the foot strap where it meets the top portion of the sole portion and also molded within the sole portion are a plurality of spikes, the spikes comprising a lower exposed portion for gripping the surface upon which the wearer walks and a upper bud portion that extends away from the lower portion at a first diameter and expands to a larger diameter farther from the lower portion, the larger diameter being molded within the sole portion and wherein the top portion of the sole portion comprises raised sides and a depressed floor portion for supporting a foot of a wearer.

14. The flip flop sandal of claim 13 wherein the largest dimension of the enlarged end portions being about 12 to 16 times larger at its largest dimension than the thickness of the foot strap where it meets the top portion of the sole portion.

15. The flip flop sandal of claim 13 wherein the largest dimension of the enlarged end portions being about 14 to 16 times larger at its largest dimension than the thickness of the foot strap where it meets the top portion of the sole portion.

16. The flip flop sandal of claim 13 wherein the largest dimension of the enlarged end portions being about 16 times larger at its largest dimension than the thickness of the foot strap where it meets the top portion of the sole portion.

* * * * *

UNITED STATES PATENT AND TRADEMARK OFFICE

CERTIFICATE OF CORRECTION

PATENT NO. : 7,584,553 B1
APPLICATION NO. : 11/400086
DATED : September 8, 2009
INVENTOR(S) : Mark M. Medley It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 824 days.

Signed and Sealed this

Fourteenth Day of September, 2010

David J. Kappos

David J. Kappos
*Director of the United States Patent and Trademark Office*